US009056654B1

(12) United States Patent
Fraser

(10) Patent No.: US 9,056,654 B1
(45) Date of Patent: Jun. 16, 2015

(54) HYDROFOIL AND WATER SPORT BOARD EQUIPPED THEREWITH

(71) Applicant: Serge Fraser, St-Joseph de Coleraine (CA)

(72) Inventor: Serge Fraser, St-Joseph de Coleraine (CA)

( * ) Notice: Subject to any disclaimer, the term of this patent is extended or adjusted under 35 U.S.C. 154(b) by 0 days.

(21) Appl. No.: 14/576,579

(22) Filed: Dec. 19, 2014

(51) Int. Cl.

| | |
|---|---|
| ***B63B 1/24*** | (2006.01) |
| ***B63B 1/26*** | (2006.01) |
| ***B63B 35/81*** | (2006.01) |
| ***B63B 35/79*** | (2006.01) |

(52) U.S. Cl.
CPC . *B63B 1/248* (2013.01); *B63B 1/26* (2013.01); *B63B 1/242* (2013.01); *B63B 1/24* (2013.01); *B63B 35/7923* (2013.01); *B63B 35/7926* (2013.01); *B63B 2035/813* (2013.01); *B63B 35/81* (2013.01)

(58) Field of Classification Search
CPC ..... B63B 1/16; B63B 1/18; B63B 1/20; B63B 1/22–1/30; B63B 35/79; B63B 2035/7903; B63B 35/7906; B63B 35/7923; B63B 35/7926; B63B 35/81; B63B 2035/813; B63B 35/815
USPC ..... 114/39.15, 39.24, 253, 272–284; 441/65, 68, 72, 73, 79; D12/309
See application file for complete search history.

(56) References Cited

U.S. PATENT DOCUMENTS

| | | | | |
|---|---|---|---|---|
| 857,951 | A * | 6/1907 | Meacham et al. | 114/281 |
| 1,186,816 | A * | 6/1916 | Meacham et al. | 114/281 |
| 3,164,119 | A * | 1/1965 | Emmanuel et al. | 114/274 |
| 4,579,076 | A * | 4/1986 | Chaumette | 114/275 |
| 4,711,195 | A * | 12/1987 | Shutt | 114/274 |
| 5,249,998 | A * | 10/1993 | Woolley et al. | 441/65 |
| 5,311,832 | A * | 5/1994 | Payne | 114/274 |
| 6,786,785 | B2 * | 9/2004 | Woolley | 441/65 |
| 7,926,437 | B2 * | 4/2011 | Townsend | 114/274 |
| 2008/0289562 | A1 * | 11/2008 | Dansie | 114/274 |

* cited by examiner

*Primary Examiner* — Ajay Vasudeva

(57) ABSTRACT

The present disclosure relates to an elongated member for a hydrofoil, to a hydrofoil with such an elongated member and to a board equipped with such a hydrofoil. The elongated member comprises a front end for affixing to a front blade having a front lift ratio and a rear end for affixing to a rear blade having a rear lift ratio in such a manner that the front blade and rear blade face in a same direction, and the rear lift ratio is greater than the front lift ratio. The elongated member further connects with an end of a post in such a manner that the front blade is further from another end of the post for connecting to the board than the rear blade.

15 Claims, 14 Drawing Sheets

HYDROFOIL AND WATER SPORT BOARD EQUIPPED THEREWITH

The present invention relates to hydrofoils, and more particularly to hydrofoils and water sport boards equipped therewith.

BACKGROUND

Hydrofoils are used in water sports, such as kneeboarding, wakeboarding, waterboarding, surfing, and kitesurfing and windsurfing boards. A hydrofoil is affixed under a water sport board so as to allow the water sport board to lift above the water level when the water sport board is moved on the water at sufficient speed. Hydrofoils are very interesting as they offer less resistance to water compared to the water sport boards on which they are installed. Furthermore, they increase the rider's overall enjoyment while requiring less physical energy.

U.S. Pat. No. 5,249,998 to Robert C. Woolley describes a water sports device on which a rider can sit, also known as a sit-down hydrofoil. The device is equipped with a hydrofoil, affixed to the bottom of a board of the water sports device. The hydrofoil comprises a forward-planning blade, a rear-planning blade and an elongated support there between. The forward-planning blade and the rear-planning blade form a plane nearly parallel to the board. The forward-planning blade is larger than the rear-planning blade, thus creates a greater lift than the rear-planning blade.

U.S. Published patent application US2008/0289562 to Stephen W. Dansie describes a hydrofoil blade guard. This hydrofoil comprises a front foil, a rear foil and a horizontal beam there between. The horizontal beam is parallel to the board to which it is attached by a post. The front foil is larger than the rear foil, and both foils are provided with guards so as to protect them from contacting other objects.

U.S. Pat. No. 7,926,437 to Townsend also describes water sport equipment equipped with a hydrofoil. The hydrofoil is secured on one end to a toe side strut outer end and on another end to a heel side strut outer end. The hydrofoil forms a curve under the board.

Current hydrofoils require a certain level of skills and experience from the rider, as they are usually unforgiving. More particularly, a false maneuver typically results in the front blade of the hydrofoil getting out of the water, the front blade loosing its lifting effect and the rider crashing in the water.

There is therefore a need for a new type of hydrofoil, which is more forgiving, and as a result can be used by riders with any level of experience.

SUMMARY

The present hydrofoil and board resolve the problems of prior art hydrofoils, by providing a hydrofoil and board that are more forgiving and can thus be used by rider with any level of experience.

According to a first aspect, the present disclosure relates to a hydrofoil to be affixed to a board. The hydrofoil comprises a front blade, a rear blade, a post and an elongated member. The front blade has a front lift ratio, and the rear blade has a rear lift ratio that is greater than the front lift ratio. The front blade and the rear blade face a same direction. The post has an end for connecting to the board. The elongated member comprising a front end affixed to the front blade and a rear end affixed to the rear blade. The elongated member further connects with another end of the post in such a manner that the front blade is further from the end of the post for connecting to the board than the rear blade.

In accordance with another aspect, the present disclosure relates to a board for watersport. The board comprises a top and a bottom a post, a front blade, a rear blade and an elongated member. The post has one end connected to the bottom. The front blade has a front lift ratio, and the rear blade has a rear lift ratio greater than the front lift ratio. The elongated member comprises a front end affixed to the front blade and a rear end affixed to the rear blade, the front blade and rear blade facing in a same direction. The elongated member further connects with another end of the post in such a manner that the front blade is further from the end of the post connected to the board than the rear blade.

In yet another aspect, the present disclosure relates to an elongated member for a hydrofoil. The elongated member comprises a front end for fixedly receiving a front blade having a front lift ratio, and a rear end for fixedly receiving a rear blade having a rear lift ratio greater than the front lift ratio. The rear end fixedly receives the rear blade in a same direction as the front blade. The elongated member further comprises a central section for affixing to a post of the hydrofoil in such a manner that the front end is lower than the rear end with respect to the post.

BRIEF DESCRIPTION OF THE DRAWINGS

Embodiments of the disclosure will be described by way of example only with reference to the accompanying drawings, in which.

DETAILED DESCRIPTION

The foregoing and other features will become more apparent upon reading of the following non-restrictive description of illustrative embodiments thereof, given by way of example only with reference to the accompanying drawings.

A hydrofoil is a structure that is installed under a water sport board and which shares many similarities with a wing. The present disclosure relates to hydrofoils to be used with watersport boards. Watersport boards include any of the following types of boards: wakeboards, waterboards, kneeboards, surfboards, kite surfing boards, and windsurfing boards. Typically, hydrofoils comprise two blades joined by an elongated member, and using a post to fix the elongated member to a board. The blades are referred to as a front blade and a rear blade. The front blade is the blade that is positioned forward when moved in water, while the rear blade is positioned behind the front blade when moved in water.

The present disclosure relates to a new and improved elongated member, to a hydrofoil including the present elongated member and to a board with such a hydrofoil. Throughout the present specification, reference will be made to the concept of lift ratio and position of the front blade with respect to the rear blade. As the present elongated member, hydrofoil and board use two blades, each blade contributing to the overall lift effect when moved in the water, the expression lift ratio is used to refer to the individual lift contribution of the front blade and the rear blade to the total lift produced by the front and rear blades. A mathematical expression for the concept of lift ratio will be provided.

Figure 1:
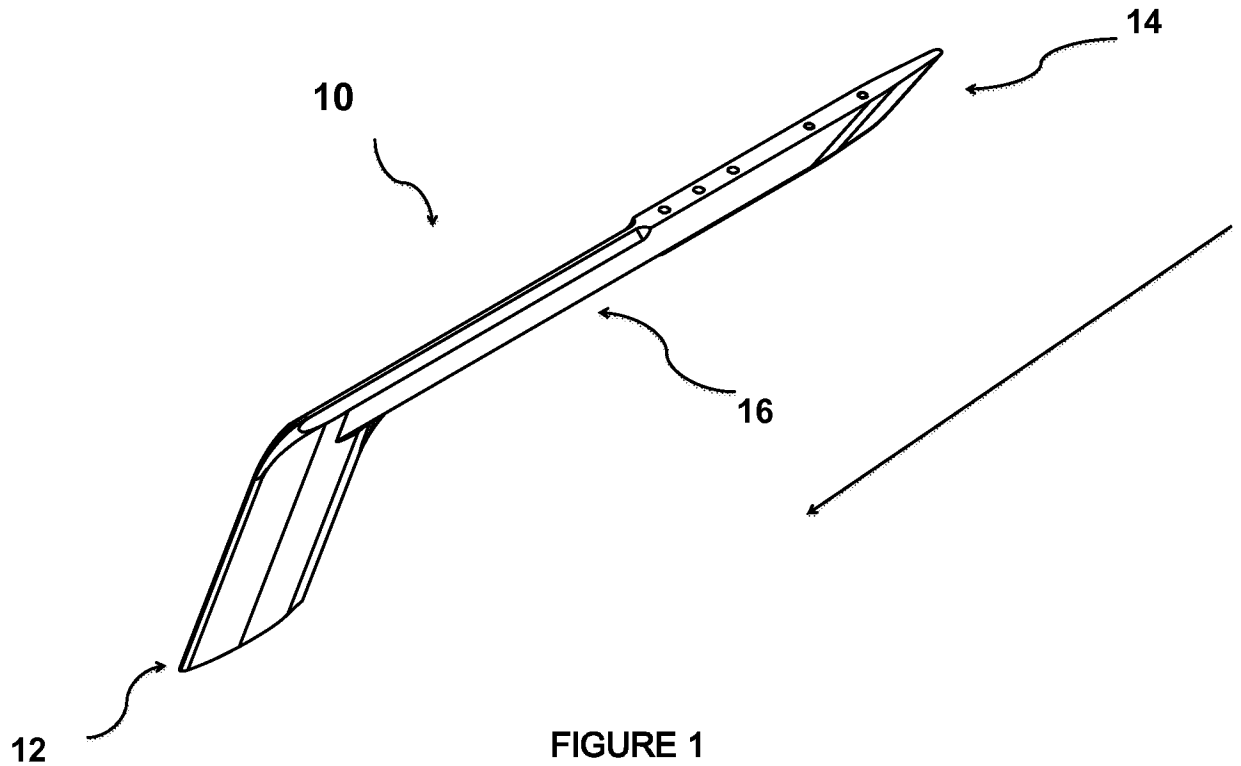
FIG. 1 is a front perspective view of the elongated member.
Figure 2:
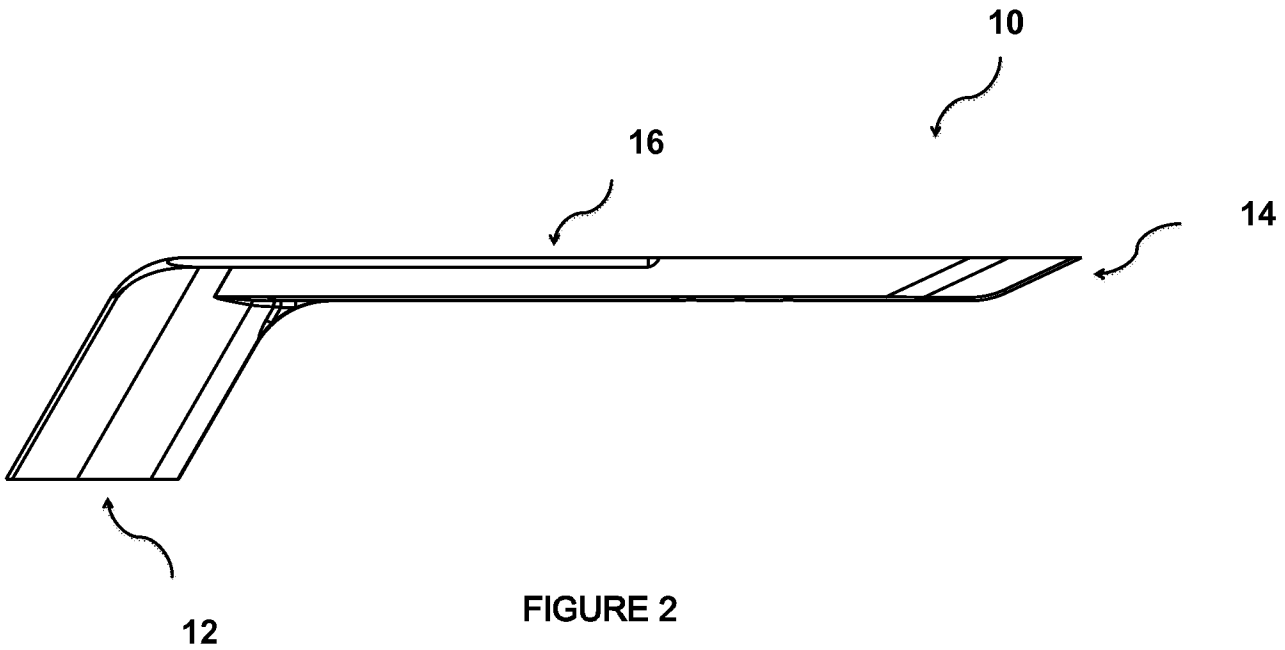
FIG. 2 is side elevation view of the elongated member of FIG. 1.
Figure 3:
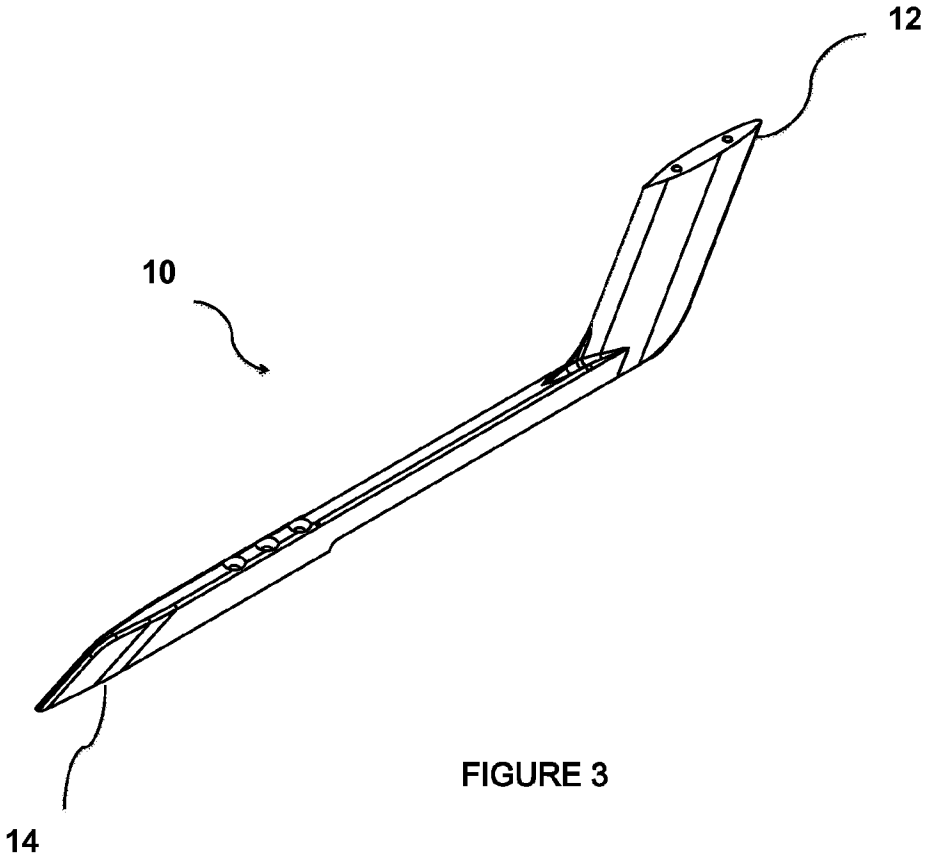
FIG. 3 is a rear bottom perspective view of the elongated member of FIG. 1.
Figure 4:
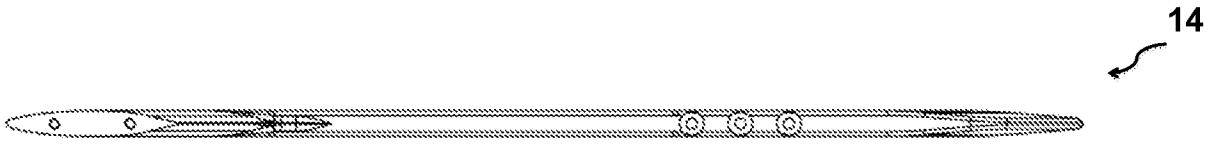
FIG. 4 is a partial bottom elevation view of the elongated member of FIG. 1.

FIGS. 1-4 depict various views of the present elongated member 10. The elongated member has a front end 12 for fixedly receiving a front blade and a rear end 14 for fixedly receiving a rear blade. The rear end 14 fixedly receives the rear blade in a same direction as the front end 12 receives the front blade. The elongated member 10 is particularly designed to receive a rear blade having a rear lift ratio greater than the front lift ratio provided by the front blade. The elongated member further includes a central section 16 for affixing to a post of a hydrofoil in such a manner that the front end 12 is lower than the rear end 14. The central section 16 may include any type of attachment, such as for example the three holes depicted on FIG. 1, for affixing to a post. The three holes shown on FIG. 1 may be through and through holes, with for inserting pins of the post, or screws connecting within the post. More particularly, the front end 12 is positioned so as to fixedly receive the front blade so as to be lower than the rear blade with respect to the post when moved in the water, as depicted by the arrow shown on FIG. 1 and pointing in a direction of movement in the water of the elongated member 10. Furthermore, the front end 12 and the rear end 14 respectively affix the front blade and the rear blade in such a manner that the front blade and rear blade are substantially parallel. Although shown as a single piece in the Figure, the elongated member 10 could be composed of several components interconnected together. The front end 12, the rear end 14 and the central section 16 are made for example of composite material, or of any material that is suitable for this type of application.

Figure 5:
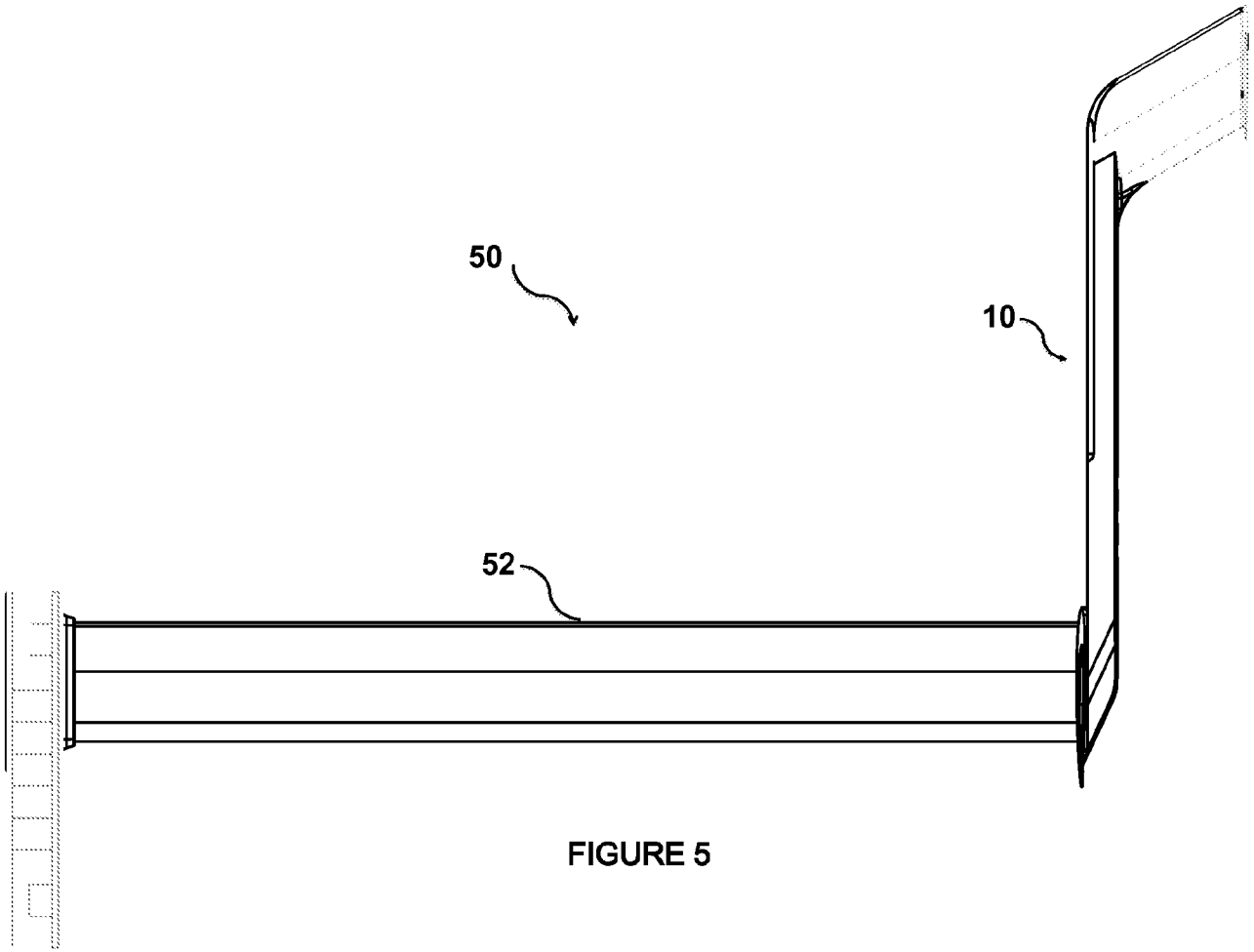
FIG. 5 is a side elevation view of a first embodiment of a hydrofoil including the elongated member of FIG. 1.
Figure 6:
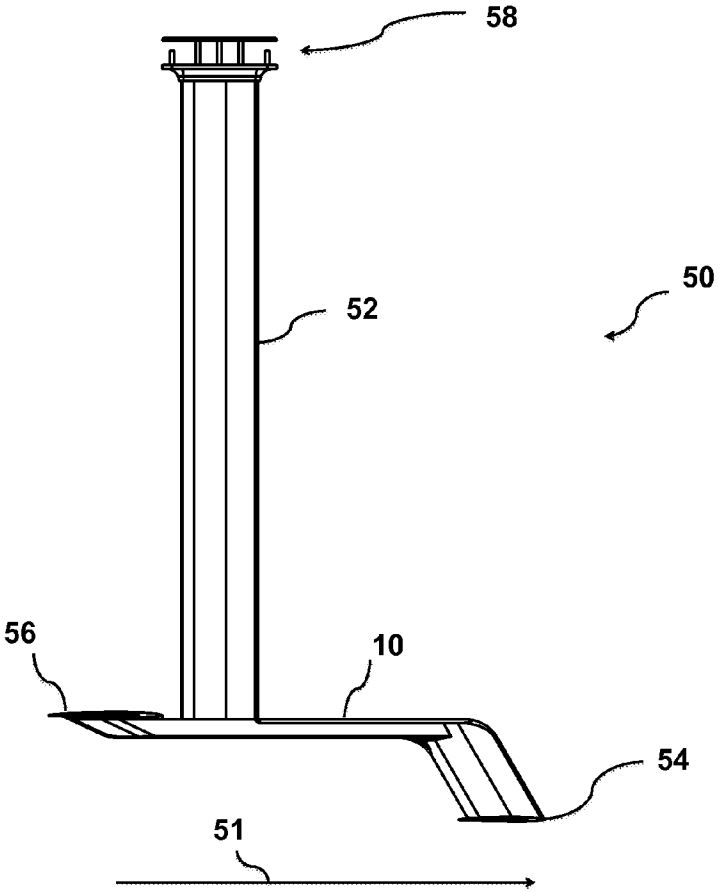
FIG. 6 is a side elevation view of a second embodiment of the hydrofoil of FIG. 5 including the elongated member of FIG. 1.
Figure 7:
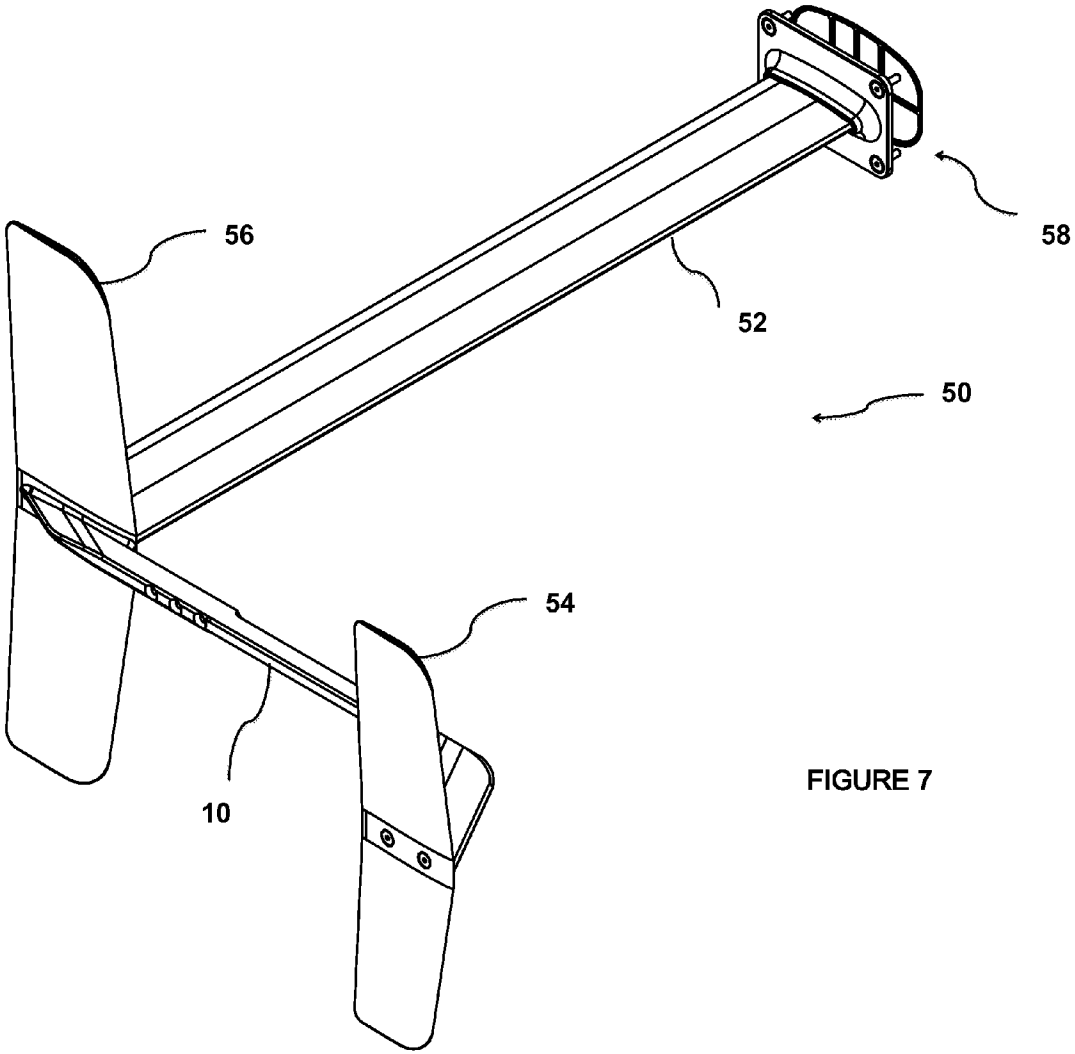
FIG. 7 is a bottom perspective view of the first embodiment of the hydrofoil.
Figure 8:
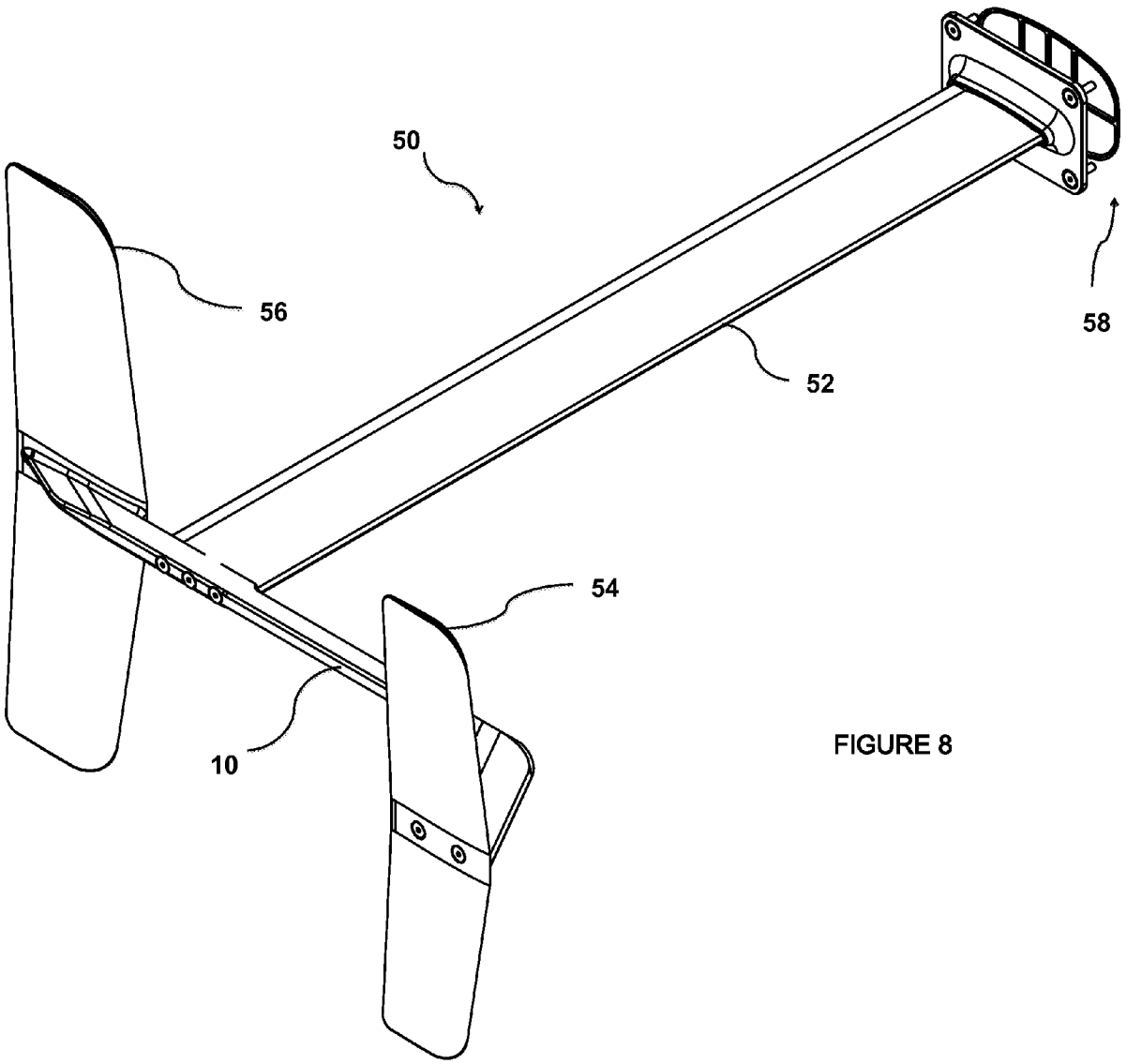
FIG. 8 is a bottom perspective view of the second embodiment of the hydrofoil.
Figure 9:
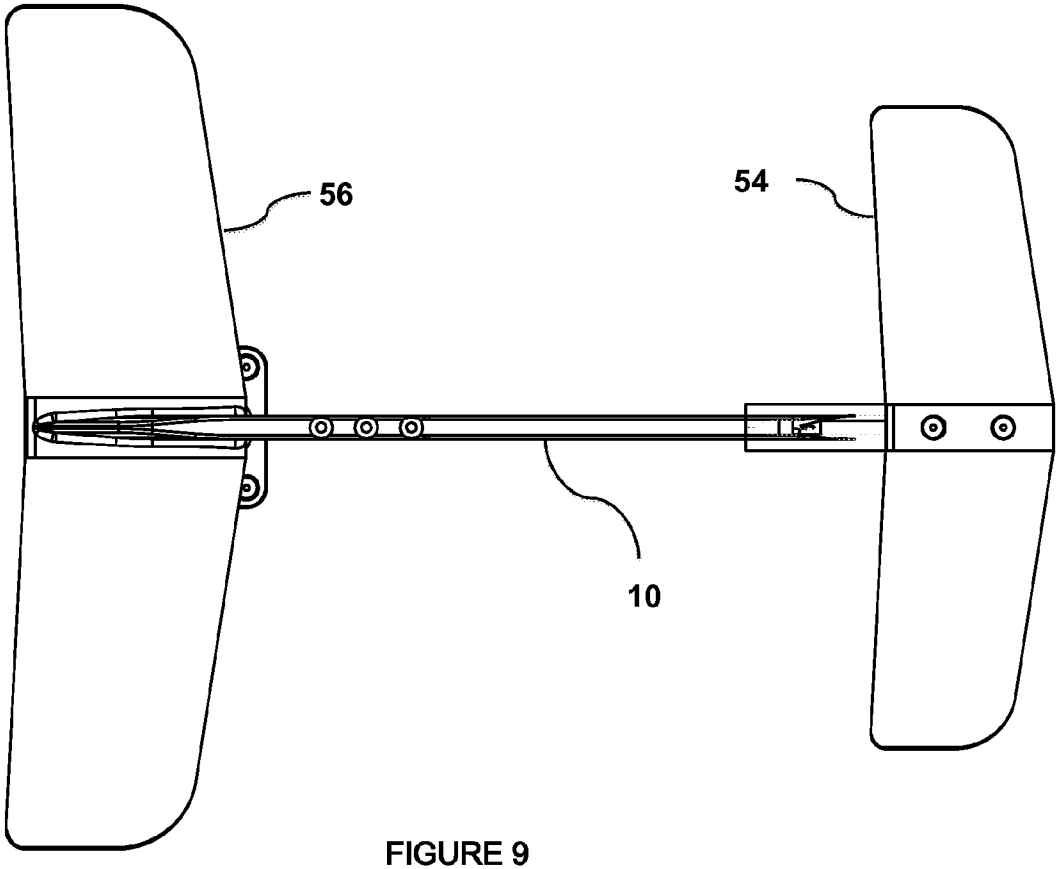
FIG. 9 is a bottom elevation view of the first embodiment of the hydrofoil.
Figure 10:
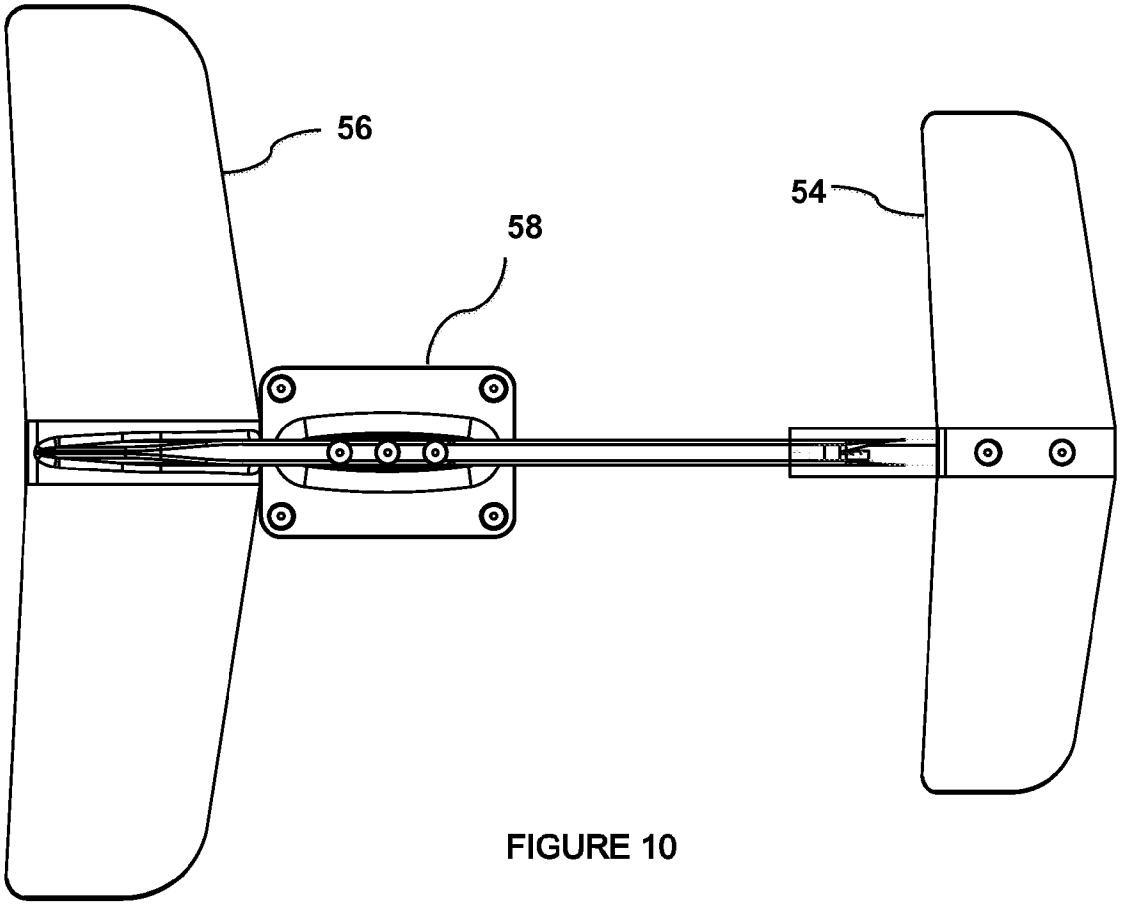
FIG. 10 is a bottom elevation view of the second embodiment of the hydrofoil.
Figure 11:
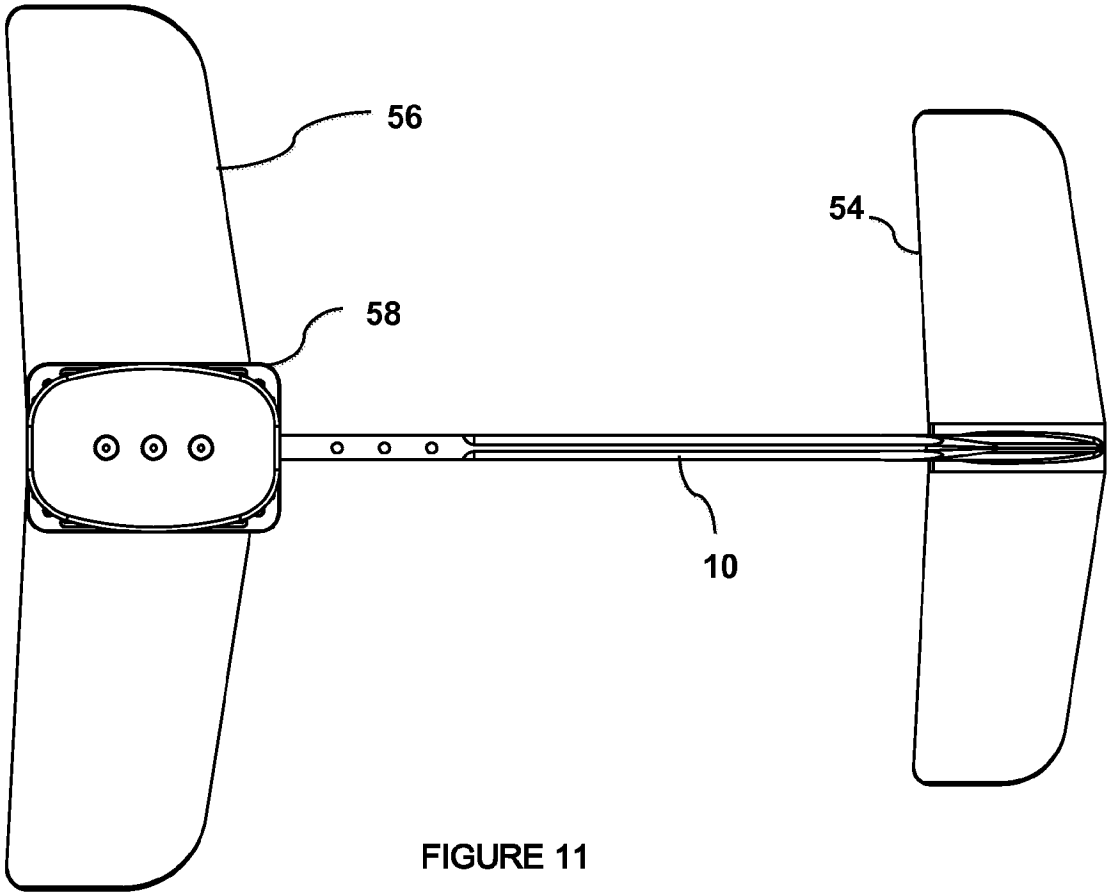
FIG. 11 is a top elevation view of the first embodiment of the hydrofoil.
Figure 12:
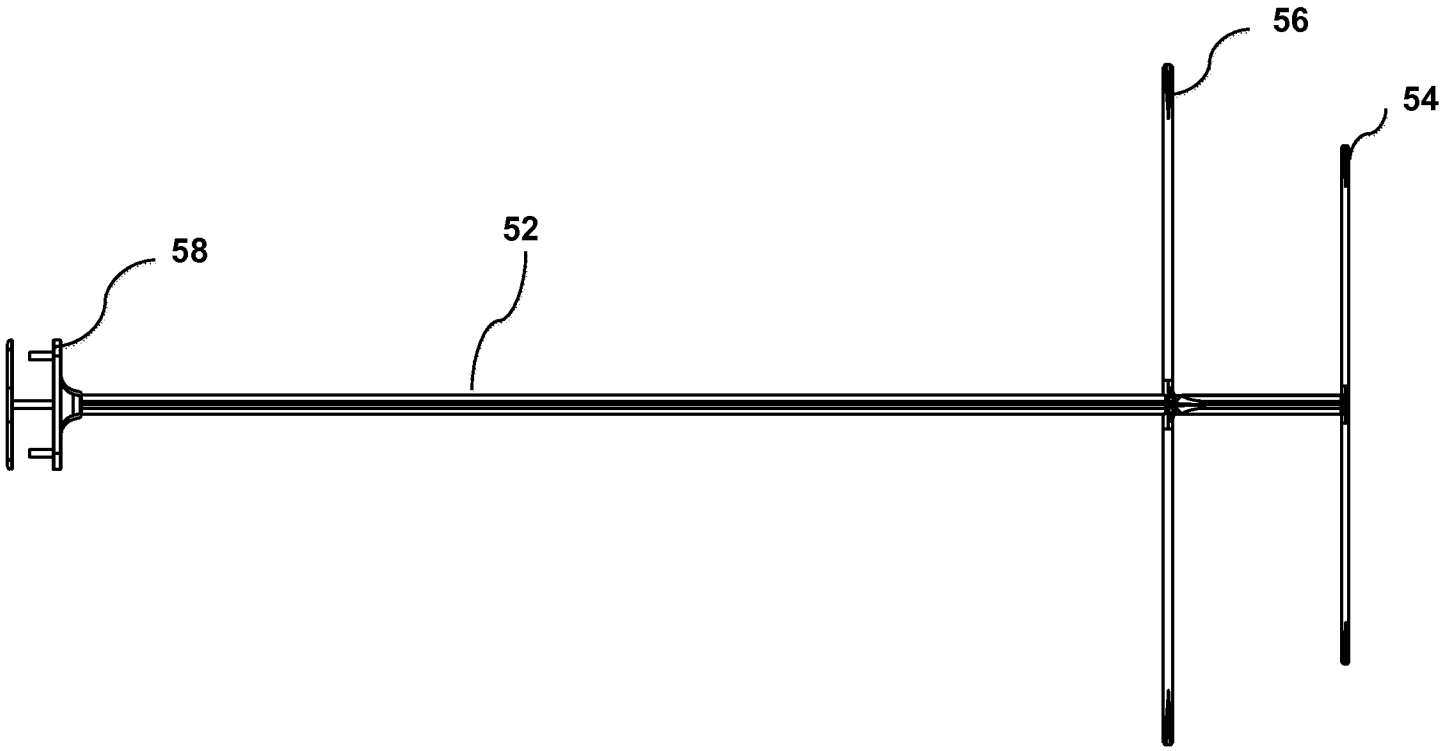
FIG. 12 is a rear elevation view of the hydrofoil.
Figure 13:
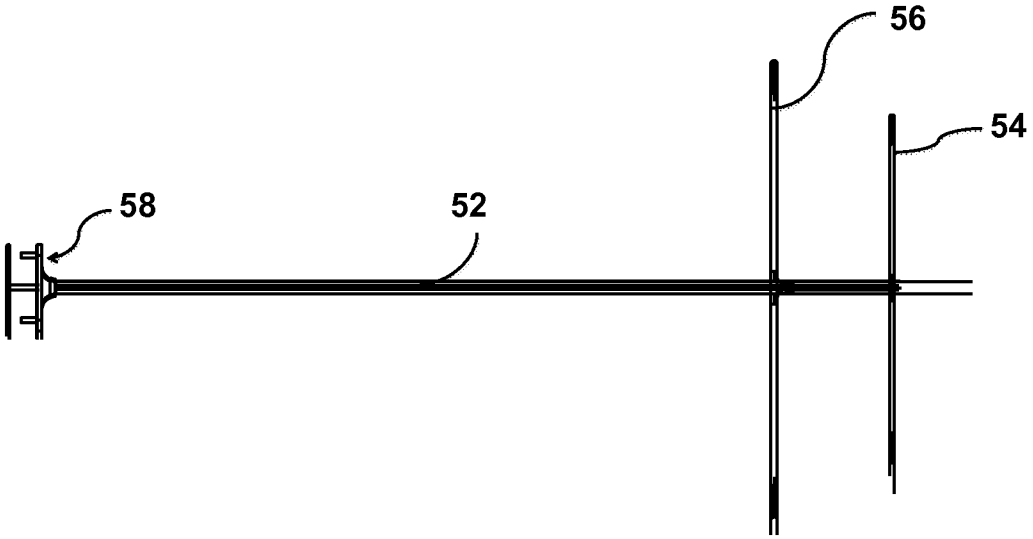
FIG. 13 is a front elevation view of the hydrofoil.
Figure 14:
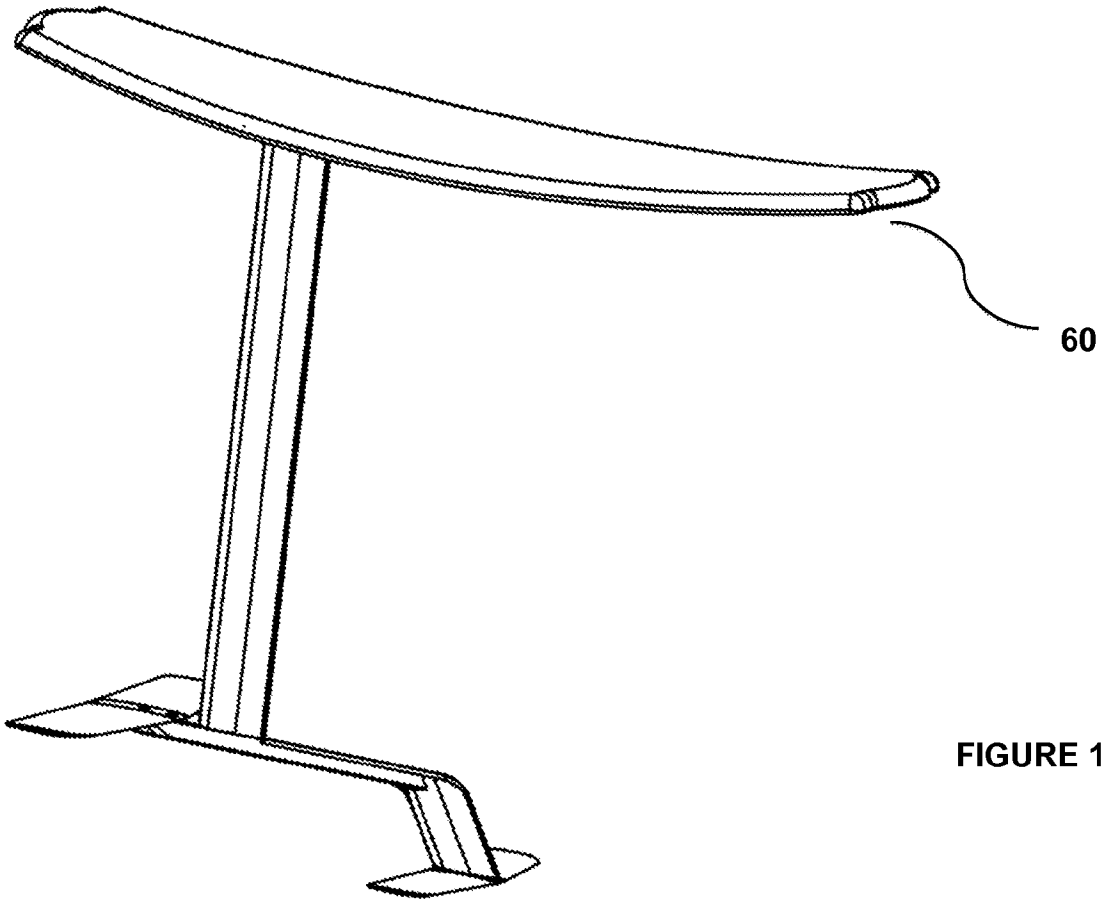
FIG. 14 is a side elevation view of a board with the present hydrofoil.

Reference is now concurrently made to FIGS. 5 to 14, which represent the present hydrofoil under different views. The present hydrofoil comprises the elongated member 10, a front blade 54, a rear blade 56 and a post 52. Both the front blade 54 and the rear blade 56 face in a same direction, i.e. the forward direction 51. The forward direction 51 corresponds to the direction in which is moved the hydrofoil in the water when installed on a board and ridden by a user. The rear blade 56 is affixed to the rear end 14 of the elongated member 10, while the front blade 54 is affixed to the front end 12 of the elongated member 10. As seen on FIGS. 5 to 13, the front blade 54 is below the rear blade 56 with respect to the post 52, and more precisely with the end of the post for connecting with a board. Furthermore, the front blade 54 and the rear blade 56 are affixed to the elongated member 10 in such a manner that the front blade 54 and the rear blade 56 are substantially parallel with one another. Although the elongated member 10 is shown as an inversed L-shape, the present elongated member 10 is not limited to such a configuration. The elongated member 10 may have various shapes, dimensions and proportions, appropriate for affixing the front blade 54 and the rear blade 56 in such a manner that the front blade 54 is positioned further from the end of the post to be connected to the board than the rear blade 56. The post 52 may be located closer to the rear blade 56, as shown on FIG. 7, or placed forward along the elongated member as shown on FIG. 8. The dimensions and proportions of the post 50 may vary depending on the type of board with which it is to be used, the type of sport practiced, the speed at which the hydrofoil 50 is to be used or the experience wanted by the rider. On FIGS. 5 to 14, the elongated member 10, the front blade 54, the rear blade 56 and the post 52 are shown as independent components interconnected with one another. However, the present hydrofoil is not limited to such an implementation. For example, one or several of the elongated member 10, the front blade 54, the rear blade 56 and the post 52 could be manufactured as one piece, or as sub-combination of pieces.

To better understand the principles used to render the present elongated member, hydrofoil and board more easily maneuverable, a brief review of the hydrodynamics principles at play is provided. When two blades of a hydrofoil are moved in water in the forward direction 51, the flow of water about the front and rear blades 54 and 56 creates pressure differences between upper surfaces and lower surfaces of each front and rear blades 54 and 56. The pressure differences produce a lift perpendicular to the flow of water. The combined lift of the front blade 54 and the rear blade 56 corresponds to the total lift. The lift produced by the front blade 54 is the front lift, while the lift produced by the rear blade 56 is the rear lift. The front lift ratio corresponds to the front lift/total lift, while the rear lift ratio corresponds to the rear lift/total lift. One way of determining the front and rear lift ratios consists of determining the relative surface of the front and rear blades when the front and rear blades have similar profiles. So the lift ratio may be calculated for each front and rear blade using the following equations:

$$Rr=Sr/(Sr+Sf)$$

$$Rf=Sf/(Sr+Sf)$$

$$Rr+Rf=1$$

where:

$R_r$ is the rear blade lift ratio;

$R_f$ is the front blade lift ratio;

$S_r$ is rear blade surface; and $S_f$ is front blade surface.

Thus when the hydrofoil 50 is affixed to a board, and the board is moved in the water, the pressure differences between the upper surfaces and lower surfaces of the front and rear blades 54 and 56 results in a lift of the board. At a certain speed, the lift produced by the front and rear blades 54 and 56 equals the weight of the board and the rider, and the board comes out of the water. As the speed is increased, and the total lift generated by the front and rear blades 54 and 56 lifts the board above the water level, the drag felt by the rider is caused only by the front and rear blades and a portion of the post instead of the board itself, thus reducing the energy required from the rider of the hydrofoil for holding on to the rope and riding the board.

The front blade 54 and the rear blade 56 are each affixed symmetrically on the elongated member 10 so as to balance the front lift ratio and the rear lift ratio on each side perpendicular to the elongated member 10. The symmetry of the front blade 54 and the rear blade 56 with respect to the length of the elongated member 10 is necessary to make the hydrofoil equally maneuverable on left and right directions by a rider of a board on which the hydrofoil is installed.

The rear blade 56 is affixed to the elongated member 10 in such a manner so as to be closer to the board than the front blade 54. Thus, when the hydrofoil 50 is moved in the water at sufficient speed, the total lift generated by the front blade 54 and the rear blade 56 lifts the board out of the water. When the total lift pushes the rear blade 56 out of the water, which is the blade that is closer to the board and thus exits the water first, the total lift reduces and lift provided by the front blade 54 is not sufficient to lift the front blade out of the water. Thus to render the hydrofoil 50 more forgiving and less prone to unexpectedly or inadvertently completely coming out of the water, the front lift ratio is lower than the rear lift ratio. Because the front blade 54 stays in the water when the rear blade 56 reaches the water surface, the rear lift is lost while the front lift is maintained. However, as the front blade 54 does not generate enough front lift to maintain the total weight of the board and the rider above water, the board lands on the surface of the water at an angle similar to a landing jump, meaning that the back of the board return to the water first, keeping the board with a positive angle relative to the water maintaining the board maneuverable by the boarder. This situation is opposed to typical hydrofoil design having the front blade supporting the main weight at the same level as the back blade. In this case, when the blades reach the surface of the water, the front blade lift is loss causing the front of board returning to the water first with a negative angle relative to the water resulting most of the time to a crash. The combination of position of rear blade 56 and front blade 54 with respect to the board, and front lift ratio and rear lift ratio keeps the hydrofoil and board maneuverable even when the hydrofoil 50 and more precisely the rear blade 56 exits the water.

The elongated member 10 is symmetrical along its length. The elongated member 10 may further be parallel to the board 60, or inclined with respect therewith. In an embodiment, the front blade 54 is affixed at least 5 centimeters below the elongated member 10, while the rear blade 56 is affixed at least 5 centimeters above the elongated member 10, along the length of the elongated member 10. For smaller boards, the front blade 54 and the rear blade 56 may be affixed to the elongated member 10 close with one another. However, the front blade 54 and the rear blade 56 must be sufficiently distant so as to avoid the flow of water flowing around the front blade 54 when the hydrofoil 50 moves in the water to create turbulence for the rear blade 56.

The post 52 may be affixed to the board 60 in any means known in watersports for fixing fins, such as the plate and pins combination 58. The end of the post 52 projecting from the elongated element 10 may further be provided with a fastening element to allow fastening of the post 50 to the board 60.

The front blade 54 and the rear blade 56 may be connected to the elongated member 10 in many different ways. For example, the front blade 54 and the rear blade 56 may be fixedly connected to the elongated member 10 in a fixed manner such as wielding and or molding. Alternately, the front blade 54 and/or the rear blade 56 may be removably connected to the elongated member 10, such as with bores and complimentary pins. Having removable front and rear blades 54 and 56 may be particularly useful to allow use of the same hydrofoil with different types of boards. Additionally, it could be advantageous to replace only one or both of the front and rear blades 54 and 56 as a rider gains in experience. Thus a rider could gradually progress from front and rear blades 54 and 56 that are more forgiving to front and rear blades 54 and 56 that are less forgiving but provide more excitement.

The front blade 54 and the rear blade 56 are connected to the elongated member 10 in such a manner as to be substantially parallel, i.e. with less than a 5° difference. In a particular embodiment, the front blade 54 and the rear blade 56 are connected to the board 60 through the elongated member 10 and post 52 so as to be parallel to the board 60.

The front blade 54, the rear blade 56, the elongated member 10 and the post 52 may be made of various materials. For example, the front blade 54, the rear blade 56, the elongated member 10 and the post 52 may be made of composite material. For convenience and sturdiness, the components of the hydrofoil 50 may be made of any material, which is light, sufficiently rigid and resistant to water. Examples of such materials include: machined aluminum, casted aluminum, extruded aluminum, fiber glass, plastic reinforced with fiber, thermoplastic and/or any other combinations of material optimizing strength, weight and cost.

The board 60 may be any type of watersport board, such as for example a water board, a kneeboard, wakeboard, a surfing board, a kite surfing board, or a windsurfing board. The post 52 is connected to the bottom 62 of the board 60. The top 64 of the board 60 may be provided with straps (not shown) for retaining the rider on the board 60, when the rider is standing on the board 60 and moves on the water.

In another particular embodiment, the post 52 may be provided with an engine (not shown) to propel the board 60. The engine allows the board 60 and hydrofoil to form an independent vessel.

Although the present disclosure has been described hereinabove by way of non-restrictive, illustrative embodiments thereof, these embodiments may be modified at will within the scope of the appended claims without departing from the spirit and nature of the present disclosure.

What is claimed is:

1. A hydrofoil comprising:

a front blade having a front lift ratio;

a rear blade having a rear lift ratio, the rear lift ratio being greater than the front lift ratio;

a post having first and second ends, the first end configured for connecting to a lower surface of a watersport board; and a substantially inverted L-shaped elongated member comprising a front end affixed to the front blade and a rear end affixed to the rear blade, the front blade and rear blade facing in a same direction, the elongated member further connecting with the second end of the post in such a manner that the front end is lower than the rear end and the front blade is further from the first end of the post for connecting to the board than the rear blade, wherein when the post is attached to the lower surface of the board the front blade is disposed in a plane lower than the rear blade.

2. The hydrofoil of claim 1, wherein a front blade lift is less than a rear blade lift.

3. The hydrofoil of claim 1, wherein the front blade generates, when moved in water a lift that is less than a weight of the board and a rider thereon.

4. The hydrofoil of claim 1, wherein:

the front blade and the rear blade are substantially parallel; and the rear blade is closer to the board than the front blade.

5. The hydrofoil of claim 1, wherein:

the front blade and the rear blade have inversed shapes.

6. The hydrofoil of claim 1, wherein the post is connected to the elongated member between the front blade and the rear blade at a position corresponding to a gravity center of a rider of the board on which the hydrofoil is to be affixed.

7. The hydrofoil of claim 1, wherein the elongated member connects the front blade and the second blade in such a manner that when the hydrofoil is moved in water, water flowing around the front blade does not affect the lift generated by the rear blade.

8. The hydrofoil of claim 4, wherein the rear blade is at least 5 cm closer to the board than the front blade.

9. The hydrofoil of claim 1, wherein the front blade, the rear blade, the elongated member and the post are made of any of the following materials taken solely or in combination: composite material, machined aluminum, casted aluminum, extruded aluminum, fiber glass, plastic reinforced with fiber, and thermoplastic.

10. A board for watersport, the board comprising:

a top;

a bottom;

a post having first and second ends, the first end connected to the bottom;

a front blade having a front lift ratio;

a rear blade having a rear lift ratio, the rear lift ratio being greater than the front lift ratio; and a substantially inverted L-shaped elongated member comprising a front end affixed to the front blade and a rear end affixed to the rear blade, the front blade and rear blade facing in a same direction, the elongated member further connecting with the second end of the post in such a manner that the front end is lower than the rear end and the front blade is further from the first end of the post for connecting to the board than the rear blade, wherein the front blade is disposed in a plane lower than the rear blade.

11. The board of claim 10, wherein a front blade lift is less than a rear blade lift.

12. The board of claim 10, wherein the front blade generates, when moved in water, a lift that is less than a weight of the board and a rider thereon.

13. The board of claim 10, wherein the post is connected to the elongated member between the front blade and the rear blade at a position corresponding to a gravity center of a rider of the board.

14. The board of claim 10, wherein the rear blade is at least 5 cm closer to the board than the front blade.

15. The board of claim 10, wherein the front blade, the rear blade, the elongated member and the post are made of composite material.

* * * * *